US006843906B1

(12) United States Patent
Eng

(10) Patent No.: US 6,843,906 B1
(45) Date of Patent: Jan. 18, 2005

(54) INTEGRATED HYDROTREATING PROCESS FOR THE DUAL PRODUCTION OF FCC TREATED FEED AND AN ULTRA LOW SULFUR DIESEL STREAM

(75) Inventor: Odette T. Eng, Lake Forest, IL (US)

(73) Assignee: UOP LLC, Des Plaines, IL (US)

( * ) Notice: Subject to any disclaimer, the term of this patent is extended or adjusted under 35 U.S.C. 154(b) by 420 days.

(21) Appl. No.: 10/151,077

(22) Filed: May 17, 2002

Related U.S. Application Data

(63) Continuation-in-part of application No. 09/657,821, filed on Sep. 8, 2000, now abandoned.

(51) Int. Cl.[7] ..... C10G 45/00; C10G 45/04

(52) U.S. Cl. ..... 208/210; 208/208 R; 208/213; 208/216 R; 208/212; 208/211; 208/217; 208/222

(58) Field of Search ..... 208/208 R, 210, 208/211, 212, 213, 216 R, 217, 222

(56) References Cited

U.S. PATENT DOCUMENTS

| | | | | |
|---|---|---|---|---|
| 3,471,398 A | 10/1969 | Borst, Jr. | ..... | 208/111 |
| 3,506,567 A | 4/1970 | Barger, Jr. et al. | ..... | 208/89 |
| 3,540,999 A | 11/1970 | Jacobs | ..... | 208/59 |
| 3,544,448 A | 12/1970 | Jacobs et al. | ..... | 208/59 |
| 3,551,323 A | 12/1970 | Hamblin | ..... | 208/58 |
| 3,579,436 A | 5/1971 | Mounce | ..... | 208/59 |
| 3,607,091 A | 9/1971 | Boyd | ..... | 23/253 |
| 3,649,519 A | 3/1972 | Watkins | ..... | 208/59 |
| 3,847,799 A | 11/1974 | Munro | ..... | 208/210 |
| 4,159,935 A | 7/1979 | Scott | ..... | 208/59 |
| 4,592,828 A | 6/1986 | Chu et al. | ..... | 208/89 |
| 5,110,444 A | 5/1992 | Haun et al. | ..... | 208/89 |
| 5,114,562 A | 5/1992 | Haun et al. | ..... | 208/89 |
| 5,203,987 A | 4/1993 | de la Fuente | ..... | 208/59 |
| 5,494,568 A | 2/1996 | Simpson et al. | ..... | 208/46 |
| 5,968,347 A | 10/1999 | Kolodziej et al. | ..... | 208/213 |

*Primary Examiner*—Walter D. Griffin
*Assistant Examiner*—Tam Nguyen
(74) *Attorney, Agent, or Firm*—John G. Tolomei; James C. Paschall; John G. Cutts, Jr.

(57) ABSTRACT

An integrated hydrotreating process which produces a high quality feed for the FCC to maintain sulfur in FCC gasoline to a level lower than 30 ppm from a high boiling feedstock and an ultra low sulfur diesel stream preferably less than 10 ppm from a cracked stock diesel boiling material. The high boiling feedstock is firstly hydrotreated to reduce the concentration of heterogeneous compounds which produces lower boiling hydrocarbonaceous compounds boiling in the diesel range. The resulting hydrocarbonaceous compounds boiling in the diesel range together with other cracked material in the diesel boiling range are further hydrotreated in a second hydrotreating zone to meet ultra low sulfur diesel specifications and high cetane index.

3 Claims, 1 Drawing Sheet

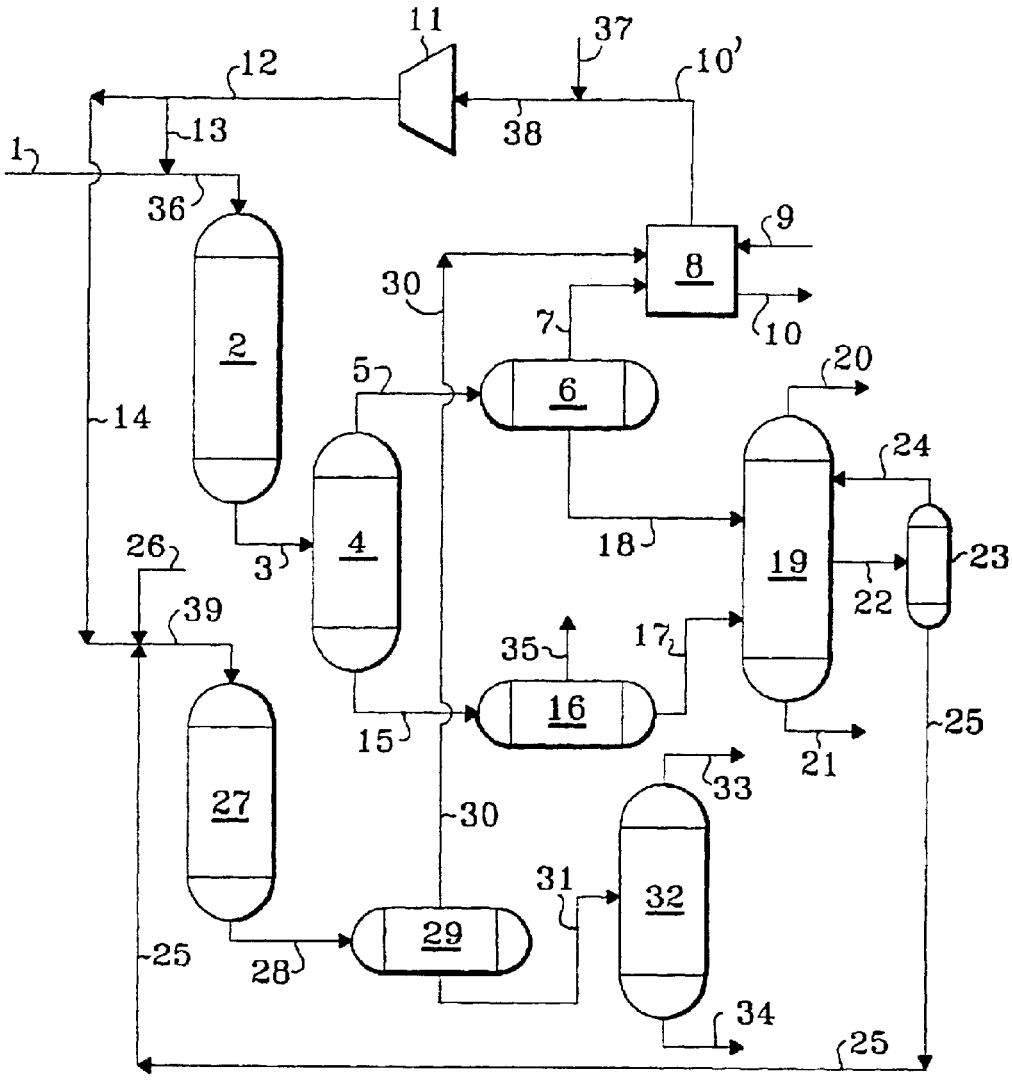
11
37
12
10'
13
38
1
36
9
8
30
7
10
2
5
6
20
14
24
4
18
19
23
26
3
22
39
35
17
16
15
25
21
27
33
30
31
32
29
25
28
34
25

INTEGRATED HYDROTREATING PROCESS FOR THE DUAL PRODUCTION OF FCC TREATED FEED AND AN ULTRA LOW SULFUR DIESEL STREAM

CROSS-REFERENCE TO RELATED APPLICATION

This application is a Continuation-In-Part application of Ser. No. 09/657,821 filed Sep. 8, 2000, now abandoned all the teachings of which are incorporated herein.

BACKGROUND OF THE INVENTION

The field of art to which this invention pertains is the preparation and treating of a fluid catalytic cracking unit (FCC) feed and the production of an ultra low sulfur diesel stream with high quality and high cetane index from a hydrocarbonaceous feedstock of straight run and/or cracked stock origin. Hydrotreating processes have been used by petroleum refiners to produce more valuable hydrocarbonaceous streams such as naphtha, gasoline, kerosene and diesel, for example, having lower concentrations of sulfur and nitrogen. Feedstocks most often subjected to hydrotreating are normally liquid hydrocarbonaceous streams such as naphtha, kerosene, diesel, gas oil, vacuum gas oil (VGO), and reduced crude, for example. Traditionally, the hydrotreating severity is selected to produce an improvement sufficient to produce a marketable product. Over the years, it has been recognized that due to environmental concerns and newly enacted rules and regulations, saleable products must meet lower and lower limits on contaminants such as sulfur and nitrogen. Recently new regulations are being proposed in the United States and Europe which basically require the complete removal of sulfur from liquid hydrocarbons which are used as transportation fuels such as gasoline and diesel.

Hydrotreating is generally accomplished by contacting the hydrocarbonaceous feedstock in a hydrotreating reaction vessel or zone with a suitable hydrotreating catalyst under conditions of elevated temperature and pressure in the presence of hydrogen so as to yield a product containing desired maximum limits of sulfur. The operating conditions and the hydrotreating catalysts within the hydrotreating reactor influence the quality of the hydrotreated products.

Although a wide variety of process flow schemes, operating conditions and catalysts have been used in commercial hydrotreating activities, there is always a demand for new hydrotreating methods which provide lower costs and required product quality and specifications. With the mandated low sulfur transportation fuels, the process of the present invention greatly improves the economic benefits of simultaneously producing hydrotreated cracking feedstocks and low sulfur diesel stocks in one unit. The hydrotreated cracking feedstock will allow the production of low sulfur gasoline to be produced from a downstream FCC unit.

INFORMATION DISCLOSURE

U.S. Pat. No. 5,494,568 (Simpson et al.) discloses a hydrocarbon conversion process wherein a feedstock is converted to upgraded hydrocarbon products in the presence of a catalyst and under hydrocarbon conversion conditions including an elevated temperature and pressure.

U.S. Pat. No. 5,203,987 (de la Fuente) discloses a process for upgrading a hydrocracked residua wherein the hydrocracked residua is separated into a first fraction and a second fraction containing between 25 and 50 wt-% aromatic compounds. The first fraction is hydrotreated and the second fraction is vacuum fractionated to produce a third fraction and a residua fraction. The third fraction is hydroprocessed and resulting hydroprocessed product is combined with the hydrotreated product to produce a fuel product containing no more than 25 vol-% aromatic compounds.

U.S. Pat. No. 3,540,999 (Jacobs) discloses a process for converting heavier hydrocarbonaceous material into jet fuel kerosene and gasoline fractions. The simultaneous production of both jet fuel and gasoline fractions is afforded through a two-stage process in which the jet fuel kerosene fraction is produced in the first stage and the gasoline fraction is produced in the second stage. A heavy hydrocarbonaceous feedstock is introduced into a first reaction zone (desulfurization) and the resulting effluent is separated into a first liquid stream and a first gaseous stream which is partially condensed to provide a second liquid stream which is introduced into a fractionation zone. The first liquid stream which is produced from the effluent from the first reaction zone is combined with a heavy hydrocarbonaceous stream from the fractionation zone which boils at a temperature above that of kerosene and a slip stream of the total kerosene produced in the fractionation zone, and the resulting admixture is introduced into a second reaction zone (hydrocracking) to produce hydrocarbonaceous compounds boiling at a temperature equal to or less than the kerosene boiling range. The effluent from the second reaction zone is partially condensed and the liquid stream therefrom is introduced into the fractionation zone to produce a jet fuel kerosene stream and a gasoline stream. The process of the '999 patent is a hydrocracking process to primarily produce jet fuel kerosene and gasoline from heavier hydrocarbonaceous feedstocks by utilizing a single desulfurization zone and a hydrocracking zone.

U.S. Pat. No. 3,506,567 (Barger, Jr., et al.) discloses a process comprising a hydrofining stage and a hydrocracking stage, wherein dual quenching media are used to quench the hydrogen-hydrocarbon mixture passing through the hydrofining stage, part of the liquid petroleum feed serving as the quenching stream to the inlet portion of the hydrofining stage and recycled hydrogen-containing gas serving as the quenching stream to the outlet portion of the hydrofining stage; hydrogen-containing gas is used to quench the hydrogen-hydrocarbon mixture passing through the hydrocracking stage; effluent from the feed preparation stage is subjected to limited cooling, followed by separation of a small amount of condensed material from the vapor at a high pressure, followed by cooling of the resulting vapor and separation of the cooled vapor into a hydrogen-containing gas and a liquid stream; and a hydrogen-containing gas is enriched prior to recycle.

U.S. Pat. No. 5,968,347 (Kolodziej et al.) discloses a hydrodesulfurization process for desulfurizing a liquid hydrocarbon feedstock containing a mixture of liquid hydrocarbons together with organic sulfurous impurities in which a first hydrocarbon fraction is contacted with a first stream of desulfurized recycle gas to produce a vaporous mixture including unreacted hydrogen, hydrogen sulfide and a second hydrocarbon fraction including relatively more volatile components of the mixture of hydrocarbons and a third liquid hydrocarbon fraction including relatively less volatile components of the mixture of hydrocarbons as well as residual sulfurous impurities, the vaporous mixture and the third liquid hydrocarbon fraction being recovered as separate streams from the contact zone. The third liquid hydrocarbon fraction is contacted with a mixture of make-up hydrogen-containing gas and desulfurized recycle gas to cause hydrodesulfirization of residual sulfurous impurities in the third liquid hydrocarbon fraction. Further processing is followed by recovering a hydrocarbon fraction as a final hydrotreated product material.

BRIEF SUMMARY OF THE INVENTION

The present invention is an integrated hydrotreating process which combines two very different functions in one unit: (1) treating VGO boiling range material to prepare feed for the FCC unit and (2) treating low quality cracked diesel boiling range material to produce an ultra low sulfur diesel stream of high quality and high cetane index. A high boiling VGO feedstock is firstly hydrotreated to reduce the concentration of sulfur such that further cracking of the VGO material in the FCC unit will produce gasoline which would meet low sulfur specifications. To avoid over-cracking the VGO material the first hydrotreating zone is required to operate at a severity sufficient to reduce the sulfur content of gasoline which is subsequently produced. The resulting hydrocarbonaceous compounds boiling in the diesel range produced from the treating of the VGO material must be further hydrotreated to meet the new low sulfur diesel specifications. A second hydrotreating zone is utilized to desulfurize only the diesel range hydrocarbons which is economically achieved by the integration of the second hydrotreating zone with the first hydrotreating zone. Feed to the second hydrotreating zone will preferably include cracked diesel from various external sources and diesel produced from the first hydrotreating zone.

In accordance with one embodiment, the present invention relates to an integrated hydrotreating process for the desulfurization of a fluid catalytic cracker (FCC) feedstock to achieve low sulfur specifications in FCC produced gasoline and the simultaneous production of an ultra low sulfur diesel stream which process comprises: a) reacting a hydrocarbonaceous feedstock having a majority boiling at a temperature greater than about 371° C. (700° F.) and hydrogen in a first denitrification and desulfurization reaction at reaction zone conditions including a temperature from about 204° C. (400° F.) to 426° C. (800° F.) and a pressure from about 3.5 MPa (500 psig) to about 17.3 MPa (2500 psig) with a catalyst to reduce the sulfur content of the feedstock and to convert less than about 20 volume percent of the feedstock to lower boiling hydrocarbons; b) passing a denitrification and desulfurization reaction zone effluent to a first vapor-liquid separator maintained at a temperature from about 149° C. (300° F.) to about 426° C. (800° F.) to produce a first vapor stream boiling in a range below that of the feedstock and containing diesel boiling range hydrocarbons, and a first liquid stream; c) cooling and partially condensing the first vapor stream to produce in a second vapor-liquid separator, a hydrogen-rich gaseous stream containing hydrogen sulfide and a second liquid stream comprising diesel boiling range hydrocarbons; d) passing the hydrogen-rich gaseous stream containing hydrogen sulfide to an acid gas scrubbing zone to produce a hydrogen-rich gaseous stream having a reduced concentration of hydrogen sulfide; e) passing the first liquid stream to a flash zone to remove dissolved hydrogen and normally gaseous hydrocarbons and then to a fractionation zone; f) passing at least a portion of the second liquid stream to the fractionation zone; g) removing a third liquid stream containing diesel boiling range hydrocarbons from the fractionation zone and passing the third liquid stream and hydrogen to a second denitrification and desulfurization zone to produce a fourth liquid stream containing reduced sulfur content, diesel boiling range hydrocarbons; h) passing at least a portion of the hydrogen-rich gaseous stream having a reduced concentration of hydrogen sulfide to the first and the second desulfurization reaction zones; and i) recovering a fluid catalytic cracking feedstock having a sulfur content lower than the feedstock and having a majority boiling at a temperature greater than about 371° C. (700° F.).

In accordance with another embodiment, the present invention relates to an integrated hydrotreating process for the desulfurization of a fluid catalytic cracker (FCC) feedstock to achieve low sulfur specifications in FCC produced gasoline and the simultaneous production of an ultra low sulfur diesel stream which process comprises: a) reacting a first hydrocarbonaceous feedstock having a majority boiling at a temperature greater than about 371° C. (700° F.) and hydrogen in a first denitrification and desulfurization reaction at reaction zone conditions including a temperature from about 204° C. (400° F.) to 426° C. (800° F.) and a pressure from about 3.5 MPa (500 psig) to about 17.3 MPa (2500 psig) with a catalyst to reduce the sulfur content of the feedstock and to convert less than about 20 volume percent of the feedstock to lower boiling hydrocarbons; b) passing a denitrification and desulfurization reaction zone effluent to a first vapor-liquid separator maintained at a temperature from about 149° C. (300° F.) to about 426° C. (800° F.) to produce a first vapor stream boiling in a range below that of the feedstock and containing diesel boiling range hydrocarbons, and a first liquid stream; c) cooling and partially condensing the first vapor stream to produce in a second vapor-liquid separator, a hydrogen-rich gaseous stream containing hydrogen sulfide and a second liquid stream comprising diesel boiling range hydrocarbons; d) passing the hydrogen-rich gaseous stream containing hydrogen sulfide to an acid gas scrubbing zone to produce a hydrogen-rich gaseous stream having a reduced concentration of hydrogen sulfide; e) passing the first liquid stream to a flash zone to remove dissolved hydrogen and normally gaseous hydrocarbons and then to a fractionation zone; f) passing at least a portion of the second liquid stream to the fractionation zone; g) removing a third liquid stream containing diesel boiling range hydrocarbons from the fractionation zone and passing the third liquid stream, a second feedstock comprising diesel boiling range hydrocarbons and hydrogen to a second denitrification and desulfurization zone to produce a fourth liquid stream containing reduced sulfur content, diesel boiling range hydrocarbons; h) passing at least a portion of the hydrogen-rich gaseous stream having a reduced concentration of hydrogen sulfide to the first and the second desulfurization reaction zones; and i) recovering a fluid catalytic cracking feedstock having a sulfur content lower than the feedstock and having a majority boiling at a temperature greater than about 371° C. (700° F.).

Other embodiments of the present invention encompass further details such as types and descriptions of feedstocks, hydrotreating catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that a more efficient and economical production of ultra low sulfur diesel stock with high cetane index while treating FCC feed can be achieved and enjoyed in the above-described integrated hydrotreating process.

The process of the present invention is particularly useful for the desulfurization of a gas oil or heavier hydrocarbon stream for subsequent conversion in a fluid catalytic cracking unit to produce low sulfur gasoline and the simultaneous production of low sulfur diesel stock.

Previously, when a heavy hydrocarbonaceous feedstock was hydrotreated prior to introduction into a fluid catalytic cracking unit (FCC) the severity of the hydrotreater was selected to permit the FCC unit to produce gasoline having the required low level sulfur requirement and the sulfur level of co-produced diesel stock in the hydrotreater was not an important consideration. Presently, with the changing requirement of ever-lower sulfur level requirements in diesel fuel, it has become important to provide an economical, integrated hydrotreating process to produce a heavy hydrocarbonaceous product which is suitable for an FCC feedstock as well as a diesel stock having a lowered sulfur concentration.

The process of the present invention is particularly useful for hydrotreating hydrocarbonaceous oil which is subsequently used as a feedstock to an FCC unit. Illustrative hydrocarbon feedstocks include those containing components boiling above 288° C. (550° F.), such as atmospheric gas oils, vacuum gas oils, deasphalted vacuum and atmospheric residua, mildly cracked residual oils, coker distillates, straight run distillates, solvent-deasphalted oils, pyrolysis-derived oils, high boiling synthetic oils, cycle oils and cat cracker distillates. A preferred hydrotreating feedstock is a gas oil or other hydrocarbon fraction having at least 50% by weight, and most usually at least 75% by weight of its components boiling at temperatures between about 316° C. (600° F.) and 538° C. (1000° F.).

The selected feedstock is first admixed with a hydrogen-rich gaseous stream and introduced into the first denitrification and desulfurization reaction zone at hydrotreating reaction conditions. Preferred denitrification and desulfurization reaction conditions or hydrotreating reaction conditions include a temperature from about 204° C. (400° F.) to about 482° C. (900° F.) and a liquid hourly space velocity of the hydrocarbonaceous feedstock from about 0.1 $hr^{-1}$ to about 10 $hr^{-1}$ with a hydrotreating catalyst or a combination of hydrotreating catalysts.

The term "hydrotreating" as used herein refers to processes wherein a hydrogen-containing treat gas is used in the presence of suitable catalysts which are primarily active for the removal of heteroatoms, such as sulfur and nitrogen and for some hydrogenation of aromatics. Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VIII metal is typically present in an amount ranging from about 2 to about 20 wt-%, preferably from about 4 to about 12 wt-%. The Group VI metal will typically be present in an amount ranging from about 1 to about 25 wt-%, preferably from about 2 to about 25 wt-%. Typical hydrotreating temperatures range from about 204° C. (400° F.) to about 482° C. (900° F.) with pressures from about 3.5 MPa (500 psig) to about 17.3 MPa (2500 psig), preferably from about 3.5 MPa (500 psig) to about 13.8 MPa (2000 psig).

The resulting effluent from the first denitrification and desulfurization reaction zone is introduced into a hot flash zone, preferably operated at a temperature from about 149° C. (300° F.) to about 426° C. (800° F.) to produce a first vaporous stream containing ammonia, hydrogen sulfide and hydrocarbonaceous compounds and a first liquid hydrocarbonaceous stream. The first vaporous stream is partially condensed and introduced into a vapor-liquid separator operated at a temperature from about 21° C. (70° F.) to about 60° C. (140° F.) to produce a hydrogen-rich gaseous stream containing hydrogen sulfide and a second liquid hydrocarbonaceous stream. The resulting hydrogen-rich gaseous stream is preferably passed through an acid gas scrubbing zone to reduce the concentration of hydrogen sulfide to produce a purified hydrogen-rich gaseous stream, a portion of which may then be recycled to each of the denitrification and desulfurization reaction zones. The first liquid hydrocarbonaceous stream is introduced into a cold flash drum to remove dissolved hydrogen and normally gaseous hydrocarbons and subsequently sent to the fractionation zone. The second liquid hydrocarbonaceous stream is introduced into the fractionation zone to produce a naphtha stream, a diesel stream and a heavy hydrocarbonaceous stream which is preferably a good candidate for a feedstock to a FCC unit.

The resulting diesel stream produced in the fractionation zone is preferably admixed with other cracked stocks in the diesel boiling range and a hydrogen-rich recycle gas stream having a low concentration of hydrogen sulfide, preferably less than about 100 wppm, and introduced into a second denitrification and desulfurization reaction zone. The resulting effluent from the second denitrification and desulfurization reaction zone is partially condensed and introduced into a cold separator preferably operating at a temperature from about 21° C. (70° F.) to about 60° C. (140° F.) to produce a hydrogen-rich gaseous stream containing hydrogen sulfide which stream is preferably passed through the same acid gas scrubbing zone to reduce the concentration of hydrogen sulfide to produce a purified hydrogen-rich gaseous stream which is preferably recycled, and a third liquid hydrocarbonaceous stream which is stripped to produce a diesel stream containing low levels of sulfur, preferably less than 50 wppm and more preferably less than 10 wppm.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil is introduced into the process via line 1 and admixed with a hereinafter-described hydrogen-rich gaseous stream transported via line 13 and the resulting admixture is carried via line 36 and introduced into denitrification and desulfurization reaction zone 2. The resulting effluent from denitrification and desulfurization reaction zone 2 is transported via line 3 and introduced into hot separator 4. A vapor stream is removed from hot separator 4 via line 5, cooled and introduced into cold vapor-liquid separator 6. A hydrogen-rich gaseous stream containing hydrogen sulfide is removed from cold vapor-liquid separator 6 via line 7 and is introduced into acid gas recovery zone 8. A lean solvent is introduced via line 9 into acid gas recovery zone 8 and contacts the hydrogen-rich gaseous stream in order to dissolve an acid gas. A rich solvent containing acid gas is removed from acid gas recovery zone 8 via line 10 and recovered. A hydrogen-rich gaseous stream containing a reduced concentration of acid gas is removed from acid gas recovery zone 8 via line 10' and is admixed with fresh makeup hydrogen which is introduced via line 37. The resulting admixture is transported via line 38 and is introduced into compressor 11. A resulting compressed hydrogen-rich gaseous stream is transported via line 12 and at least a portion is recycled via line 13 as described hereinabove. A liquid hydrocarbonaceous stream is removed from cold vapor-liquid separator 6 via line 18 and introduced into fractionation zone 19. A hot liquid hydrocarbonaceous stream is removed from hot separator 4 via line 15, cooled and introduced into cold flash drum 16. A gaseous stream containing hydrogen and normally gaseous hydrocarbons is removed from cold flash drum 16 via line 35. A liquid hydrocarbonaceous stream is removed from cold flash drum 16 via line 17 and introduced into fractionation zone 19. A naphtha stream is removed from fractionation zone 19 via line 20 and recovered. A diesel stream is removed from fractionation zone 19 via line 22 and introduced into diesel stripper 23. A gaseous stream is removed from diesel stripper 23 via line 24 and introduced into fractionation zone 19. A stripped diesel stream is removed from diesel stripper 23 via line 25 and is admixed with a hydrogen-rich recycle gas provided via lines 12 and 14 and a cracked hydrocarbon stream boiling in the diesel range introduced via line 26, and the resulting admixture is carried via line 39 and introduced into denitrification and desulfurization reaction zone 27. An effluent is removed from denitrification and desulfurization reaction zone 27 via line 28, cooled, partially condensed and introduced into cold separator 29. A hydrogen-rich gaseous stream containing hydrogen sulfide is removed from cold separator 29 via line 30 and introduced into acid gas recovery zone 8. A liquid hydrocarbonaceous stream is removed from cold separator 29 via line 31 and introduced into stripper 32. A naphtha stream is removed from stripper 32 via line 33 and recovered. A stripped low sulfur diesel stream is removed from stripper 32 via line 34 and recovered. A high boiling liquid hydrocarbonaceous stream is removed from fractionation zone 19 via line 21 and recovered.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A vacuum gas oil (VGO) feedstock blend in an amount of 100 mass units and having the characteristics presented in Table 1 is admixed with hydrogen and introduced into a denitrification and desulfurization reaction zone (VGO) to reduce the sulfur and nitrogen concentration of the effluent hydrocarbons. The resulting effluent from the denitrification and desulfurization reaction zone is fractionated to produce 3 mass units of naphtha, 15.7 mass units of diesel (191° C. to 346° C., 375° F. to 655° F. boiling range) having a sulfur concentration of 90 wppm and 78.6 mass units of FCC feed (346° C. +, 655° F. +) having a sulfur concentration of 1000 wppm. The resulting diesel with 90 wppm sulfur plus fresh feed of other cracked stock diesel boiling material in an amount of 82 mass units and having the characteristics presented in Table 2 is introduced into a second integrated denitrification and desulfurization reaction zone (diesel) at operating conditions sufficient to produce 96.3 mass units of diesel product having a sulfur concentration of <10 wppm.

The integrated process of the present invention allows the diesel reactor to operate at the same pressure level as that of the VGO reactor as well as having sweet hydrogen circulation thereby permitting the production of a diesel product having ultra low sulfur concentrations and high cetane index. The present invention achieves lower capital cost and operating costs due to the shared or eliminated equipment costs. In addition, the capital investment cost is expected to be about 10% less than the previous flow schemes.

TABLE 1

| VGO Feedstock Analysis | |
|---|---|
| Density, 15° C. | 0.946 |
| Distillation, vol-% | |
| IBP, ° C. (° F.) | 195 (385) |
| 10 | 359 (679) |
| 30 | 389 (733) |
| 50 | 414 (778) |
| 70 | 452 (845) |
| 90 | 505 (943) |
| FBP | 565 (1050) |
| Sulfur, wt-% | 3.0 |
| Nitrogen, wppm | 1600 |

TABLE 2

| Diesel Feedstock Analysis | |
|---|---|
| Density, 15° C. | 0.898 |
| Distillation, Vol-% | |
| IBP, ° C. (° F.) | 154 (310) |
| 10 | 226 (440) |
| 30 | 260 (500) |
| 50 | 282 (540) |
| 70 | 299 (570) |
| 90 | 326 (620) |
| FBP | 357 (675) |
| Sulfur, wt-% | 1.0 |
| Nitrogen, wppm | 600 |

The foregoing description, drawing and illustrative embodiment clearly en illustrate the advantages encompassed by the process of the present invention and the benefits to be afforded with the use thereof.

What is claimed is:

1. An integrated hydrotreating process for the desulfurization of a fluid catalytic cracker (FCC) feedstock to achieve low sulfur specifications in FCC produced gasoline and the simultaneous production of an ultra low sulfur diesel stream which process comprises:

a) reacting a hydrocarbonaceous feedstock having a majority boiling at a temperature greater than about 371° C. (700° F.) and hydrogen in a first denitrification and desulfurization reaction at reaction zone conditions including a temperature from about 204° C. (400° F.) to 426° C. (800° F.) and a pressure from about 3.5 MPa (500 psig) to about 17.3 MPa (2500 psig) with a catalyst to reduce the sulfur content of the feedstock and to convert less than about 20 volume percent of the feedstock to lower boiling hydrocarbons;

b) passing a denitrification and desulfurization reaction zone effluent to a first vapor-liquid separator maintained at a temperature from about 149° C. (300° F.) to about 426° C. (800° F.) to produce a first vapor stream boiling in a range below that of the feedstock and containing diesel boiling range hydrocarbons, and a first liquid stream;

c) cooling and partially condensing the first vapor stream to produce in a second vapor-liquid separator, a hydrogen-rich gaseous stream containing hydrogen sulfide and a second liquid stream comprising diesel boiling range hydrocarbons;

d) passing the hydrogen-rich gaseous stream containing hydrogen sulfide to an acid gas scrubbing zone to produce a hydrogen-rich gaseous stream having a reduced concentration of hydrogen sulfide;

e) passing the first liquid stream to a flash zone to remove dissolved hydrogen and normally gaseous hydrocarbons and then to a fractionation zone;

f) passing at least a portion of the second liquid stream to the fractionation zone;

g) removing a third liquid stream containing diesel boiling range hydrocarbons from the fractionation zone and passing the third liquid stream and hydrogen to a second denitrification and desulfurization zone to produce a fourth liquid stream containing reduced sulfur content, diesel boiling range hydrocarbons;

h) passing at least a portion of the hydrogen-rich gaseous stream having a reduced concentration of hydrogen sulfide to the first and the second desulfurization reaction zones; and i) recovering a fluid catalytic cracking feedstock having a sulfur content lower than the feedstock and having a majority boiling at a temperature greater than about 371° C. (700° F.).

2. The process of claim 1 wherein a second feedstock comprising diesel boiling range hydrocarbons is introduced into the second denitrification and desulfurization zone.

3. An integrated hydrotreating process for the desulfurization of a fluid catalytic cracker (FCC) feedstock to achieve low sulfur specifications in FCC produced gasoline and the simultaneous production of an ultra low sulfur diesel stream which process comprises:

a) reacting a first hydrocarbonaceous feedstock having a majority boiling at a temperature greater than about 371° C. (700° F.) and hydrogen in a first denitrification and desulfurization reaction at reaction zone conditions including a temperature from about 204° C. (400° F.) to 426° C. (800° F.) and a pressure from about 3.5 MPa (500 psig) to about 17.3 MPa (2500 psig) with a catalyst to reduce the sulfur content of the feedstock and to convert less than about 20 volume percent of the feedstock to lower boiling hydrocarbons;

b) passing a denitrification and desulfurization reaction zone effluent to a first vapor-liquid separator maintained at a temperature from about 149° C. (300° F.) to about 426° C. (800° F.) to produce a first vapor stream boiling in a range below that of the feedstock and containing diesel boiling range hydrocarbons, and a first liquid stream;

c) cooling and partially condensing the first vapor stream to produce in a second vapor-liquid separator, a hydrogen-rich gaseous stream containing hydrogen sulfide and a second liquid stream comprising diesel boiling range hydrocarbons;

d) passing the hydrogen-rich gaseous stream containing hydrogen sulfide to an acid gas scrubbing zone to produce a hydrogen-rich gaseous stream having a reduced concentration of hydrogen sulfide;

e) passing the first liquid stream to a flash zone to remove dissolved hydrogen and normally gaseous hydrocarbons and then to a fractionation zone;

f) passing at least a portion of the second liquid stream to the fractionation zone;

g) removing a third liquid stream containing diesel boiling range hydrocarbons from the fractionation zone and passing the third liquid stream, a second feedstock comprising diesel boiling range hydrocarbons and hydrogen to a second denitrification and desulfurization zone to produce a fourth liquid stream containing reduced sulfur content, diesel boiling range hydrocarbons;

h) passing at least a portion of the hydrogen-rich gaseous stream having a reduced concentration of hydrogen sulfide to the first and the second desulfurization reaction zones; and i) recovering a fluid catalytic cracking feedstock having a sulfur content lower than the feedstock and having a majority boiling at a temperature greater than about 371° C. (700° F.).

* * * * *